US010258177B2

(12) United States Patent
Mertzel

(10) Patent No.: US 10,258,177 B2
(45) Date of Patent: Apr. 16, 2019

(54) BUTTER DISH WITH SECURABLE SPREADER IN ROTATABLE LID

(71) Applicant: Joelle Mertzel, Porter Ranch, CA (US)

(72) Inventor: Joelle Mertzel, Porter Ranch, CA (US)

( * ) Notice: Subject to any disclaimer, the term of this patent is extended or adjusted under 35 U.S.C. 154(b) by 182 days.

(21) Appl. No.: 15/336,729

(22) Filed: Oct. 27, 2016

(65) Prior Publication Data

US 2018/0116434 A1 May 3, 2018

(51) Int. Cl.
*A47G 19/26* (2006.01)

(52) U.S. Cl.
CPC ..... *A47G 19/26* (2013.01)

(58) Field of Classification Search
CPC ..... A47G 19/26; A47G 19/265; A47G 19/00; A47G 19/02; B65D 43/16; B65D 43/14
USPC ..... 220/574–575, 244, 263, 283, 810, 836, 220/837, 840–843, 847, 848; 99/324
See application file for complete search history.

(56) References Cited

U.S. PATENT DOCUMENTS 2,840,907 A * 7/1958 Herman ..... A47G 19/26 83/607
3,268,111 A * 8/1966 Duddy ..... A47G 19/26 206/229
D259,690 S * 6/1981 Buchsteiner nee Fetzer ..... D7/502
4,892,225 A * 1/1990 von Zelewski ..... A47G 19/26 220/592.15
4,964,745 A * 10/1990 Deitz ..... A47G 19/26 401/12
7,293,846 B2 * 11/2007 Collins ..... F25D 23/04 220/661
8,267,269 B2 * 9/2012 Gundersen ..... A47G 19/26 220/212
9,516,962 B2 * 12/2016 Mertzel ..... B65D 25/28
2004/0011216 A1 1/2004 Jodrey
2012/0111873 A1 * 5/2012 Gabriel ..... A47G 19/06 220/574.1

OTHER PUBLICATIONS

Butter dish with internal spreader, closed. Google search.
Butter dish with internal spreader, open. Google search.
Four butter dishes with spreaders. Google search.
Butter dish with internal spreader. Google search.
Butter dish with external spreader on lid. Google search.
Butter dishes with external spreader on lid. Google search.
Butter container with spreader on handle. Google search.
Butter dish with spreader on handle. Google search.

* cited by examiner

*Primary Examiner* — Kareen K Thomas
(74) *Attorney, Agent, or Firm* — Joseph Golant

(57) ABSTRACT

A butter dish having a rotatable lid that opens to an obtuse angle to give wide access to butter stored on a base covered by the lid. The butter dish includes a slot in a side panel of the lid for securing a spreader. Magnets may be mounted to the lid and to the spreader to enhance attachment of the spreader to the lid.

16 Claims, 13 Drawing Sheets

BUTTER DISH WITH SECURABLE SPREADER IN ROTATABLE LID

PRIORITY CROSS-REFERENCE TO RELATED APPLICATION

This application is a continuation-in-part of co-pending patent application Ser. No. 14/635,359, filed on Mar. 2, 2015, to which applicant claims priority under 35 USC 120 for common subject matter. Applicant expressly incorporates herein the above-identified Application by this reference.

FIELD OF THE INVENTION

The present invention relates to a butter dish, and more particularly, to a butter dish with a rotatable lid to which a butter spreader is securable. When secured most of the spreader may be located within the lid and thus hidden from view when the lid is closed.

BACKGROUND OF THE INVENTION

Butter dishes are well known containers for sticks or blocks of butter. Typically, the butter dish includes a dish or plate for supporting the butter and a removable cover that is lifted off the dish to provide access to the butter. Several problems exist with such butter dishes including close spacing between the cover and the butter and handling of the cover when the cover is lifted off the dish. The close spacing means that the cover often comes into contact with the butter when moving away from the dish and/or when the cover is returned to the dish. This translates to greasy butter being deposited on the cover and then transferred to the region between the cover and the dish when the two are brought together again. Having butter between the cover and the dish ruins the quality of the seal of the cover to the dish as well as being messy.

Greasy butter may also be transferred to the countertop or table where the cover is set down during the process of removing a pat of butter and applying the butter to another item, such as a slice of bread. To avoid leaving greasy butter on a countertop, a user may attempt to set the cover upside down on the countertop, but this is often difficult because a handle for the cover may be on top of the cover so that the cover is not stable and may fall to the floor and break; also handling of the cover is difficult because it is difficult to grab an upside down cover.

Another problem is that butter left between the cover and the plate softens if left at room temperature but will then fuse the cover to the dish should the butter dish be placed in a refrigerator. When next used the cover will be difficult to open or remove and may even be dangerous as a consumer struggles with the cover.

A different type of butter dish, one with a hinged or roll top, tends to be somewhat complicated structurally and limiting in that such dishes only open to 90° and thus these butter dishes constrict access to the butter by a user manipulating a butter spreader. With such a restricted opening butter may accidently be smeared on the cover or on the lip of a dish.

Still another problem encountered with butter dishes relates to the butter spreader. Typically, a butter dish is enlarged to support a spreader. This type of butter dish may not fit in a refrigerator butter compartment. In some cases, a notch is provided to allow a spreader to rest on a dish and extend out from under a cover. Or, an outer support is provided on a dish or on a cover for holding a spreader. For example, U.S. Publication No. 2004/0011216 illustrates a depression formed in the top of a cover for storing a spreader. This arrangement results in greasy butter residue residing on the cover. U.S. Pat. No. 2,840,907 illustrates, in one embodiment, openings in the top of an interior tray for storing a spreader, and in another embodiment, spring clips attached to the top of the cover, the clips for holding a spreader. Such butter dishes that hide the spreader solve the unsightliness problem but none of the dishes have a hinged or rotatable cover where the cover offers a large opening to allow a user good access to stored butter (or other products) and where the spreader is secured out-of-way.

The invention described below addresses in detail these and other deficiencies of the prior art. The features and advantages of the present invention will be explained in, or become apparent from, the following summary and description of the preferred embodiment considered together with the accompanying drawings.

SUMMARY OF THE INVENTION

In accordance with the present application, an advantageous method and apparatus are disclosed. The apparatus takes the form of a sleek and stylish butter dish that is easy to use, simply constructed and opens widely enough to avoid, when used, butter smearing on parts of the butter dish. In addition to being stylish, easy to use and simply constructed, the butter dish disclosed herein is structurally robust, relatively inexpensive and provides easy access to the stored butter because the closure opens to more than 90°. The butter dish structure may be scaled up in size or down as a function of the shape of the block of butter to be enclosed or of the size of opening desired and yet, the butter dish is still relatively compact. To insure greater compactness, a spreader is securable to a rotatable lid and may reside mostly inside of the lid away from surfaces of a dish and the lid, and the spreader is able to move with the lid until removed by a user.

Briefly summarized, the present invention relates to a butter dish with a rotatable lid and a spreader including a base for supporting butter, a rear wall connected to the base for defining a rotational axis, the rotational axis being spaced from the base, a spreader, and a lid rotatably connected to the rear wall, the lid having a front panel and two spaced apart side panels wherein one of the two side panels includes a slot adjacent to the front panel for securing the spreader to the lid.

The invention also relates to a method for making a butter dish with a spreader including the steps of forming a base with a rear wall, the base for receiving butter, forming an axis of rotation on the rear wall above the base, attaching a rotatable lid to the rear wall, the lid having a front panel, a top panel and two spaced apart side panels, forming a slot in one of the side panels adjacent to the front panel, and providing a spreader to enable the spreader to be secured to the lid when the spreader is inserted into the slot.

BRIEF DESCRIPTION OF THE DRAWINGS

For the purpose of facilitating an understanding of the invention, the accompanying drawings and detailed description illustrate a preferred embodiment thereof, from which the invention, its structure, its construction and operation, its processes, and many related advantages may be readily understood and appreciated.

DESCRIPTION OF THE PREFERRED EMBODIMENT

Figure 1:
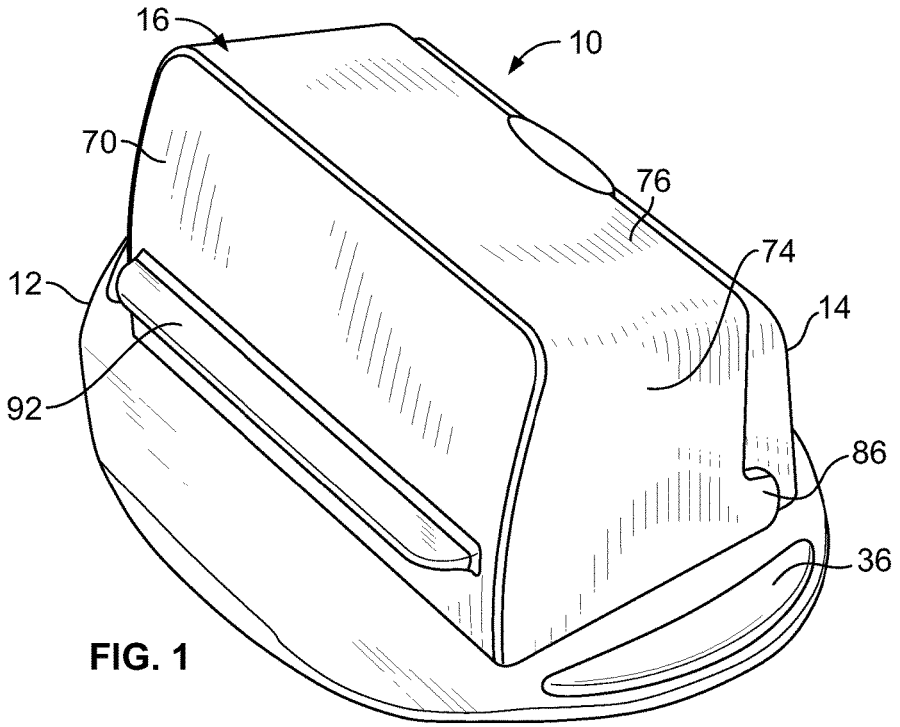
FIG. 1 is an isometric view of a butter dish illustrating the front and side of the apparatus in the closed position.

The following description is provided to enable those skilled in the art to make and use the described inventive embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring to FIGS. 1-4, there is illustrated a butter dish 10 with a rotatable cover, closure or lid. The butter dish 10 includes a stylized base, dish or plate 12, a rear wall 14 and a stylized rotatable lid 16. The butter dish 10 is shown in a first or closed position in FIGS. 1 and 2, and in a second or opened position in FIG. 3, where a block of butter 18, drawn in phantom lines, and a butter knife or spreader 20 are also shown.

The base 12, FIGS. 5-8, may have a generally oval shape in plan view (see FIG. 8) with a top surface 22 having a flat or planar region 24 for receiving butter and a front recessed region 26 for storing the butter spreader 20. The top surface 22 may also include two spaced apart slots 30, 32 positioned toward the rear of the top surface 22 for mounting the rear wall 14. Near the ends along the long dimension of the oval base 12 are two attached side grips, handles or pads 34, 36 to facilitate holding and handling of the butter dish 10. Spaced a predetermined distance from the top surface 22 of the base 12 is a bottom surface in the form of an oval shaped rim 40. The rim 40 may include a non-skid surface or be covered by a non-skid element. The rim 40 is designed to support the butter dish 10 on a support surface 42, FIG. 4, drawn in dotted lines, such as a kitchen countertop or a table. As will be explained below, the dimension between the top and bottom surfaces 22, 40 is chosen along with other dimensions to ensure that the lid 16 opens to an obtuse angle regardless of the size of the block of butter enclosed in the butter dish. The recessed region 26 of the base may include a front lip portion 44 for restraining the butter spreader 20. The front lip 44 is located at an opposite end of the minor axis of the base from a base rear end 46.

In the alternative, the base 12 may have a different geometric shape in plan view, such as being more rectangular, square, or trapezoidal, or even circular or a blending of these or other shapes. The bottom rim 40 may also have a different geometric shape, such as a rectangle, a square or a circle, or simply a flat surface. Or, other shapes may be used as long as those shapes of the bottom surface of the base provide that the base and, therefore the butter dish, is stable when placed on the support surface. Also in the alternative, the top surface 22 may be coated, roughened or grooved to better restrain the butter from easily moving around the top surface. Or, the base may support a removable dish. The top surface may also include a recessed region for the butter, if desired.

Figure 2:
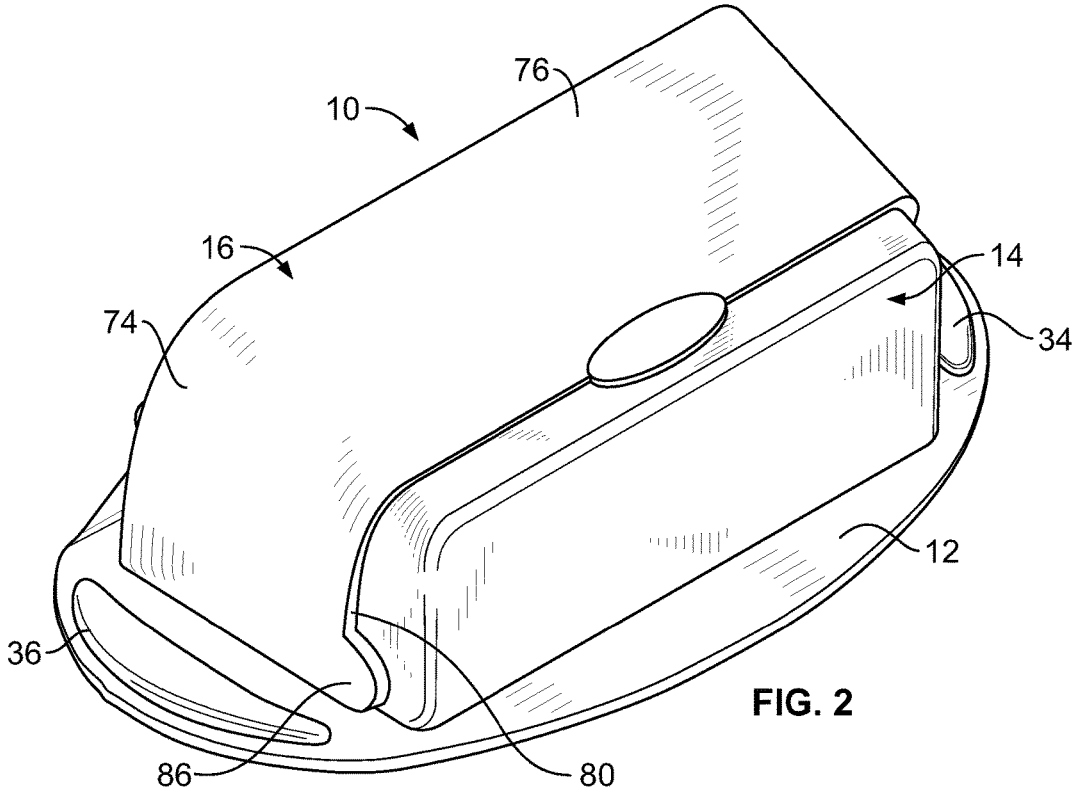
FIG. 2 is an isometric view of the rear and side of the closed butter dish shown in FIG. 1.
Figure 3:
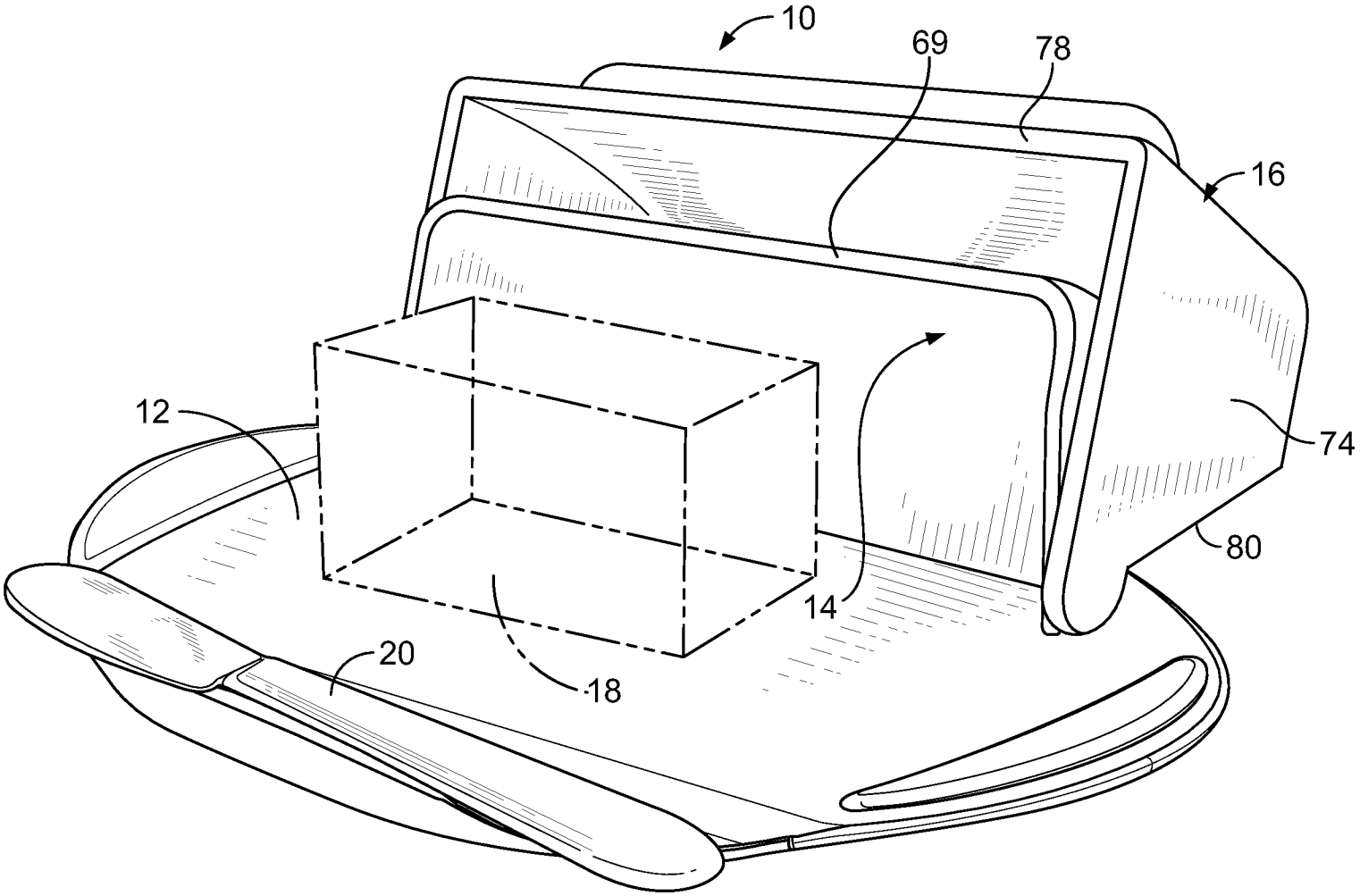
FIG. 3 is an isometric view of the butter dish shown in FIGS. 1 and 2, but in an opened position and illustrating a block of butter (in phantom lines) and a butter spreader.
Figure 9:
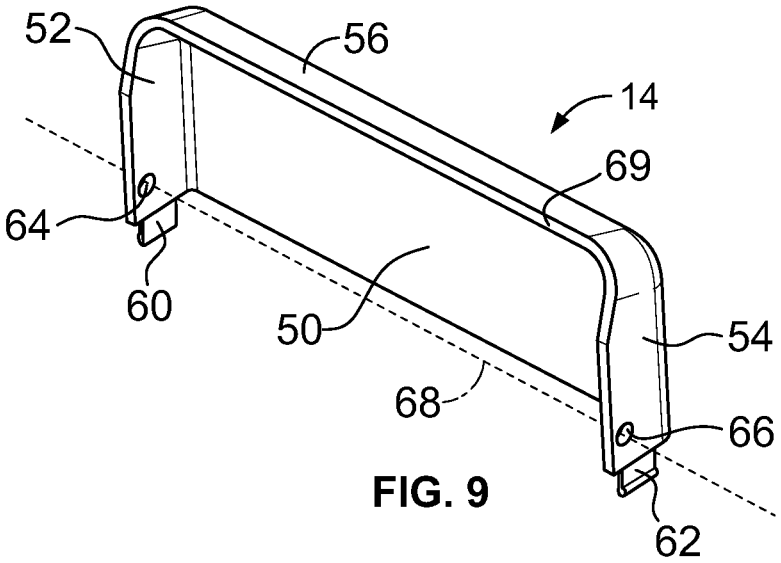
FIG. 9 is an isometric view of a rear wall of the butter dish shown in FIGS. 1-4.
Figure 10:
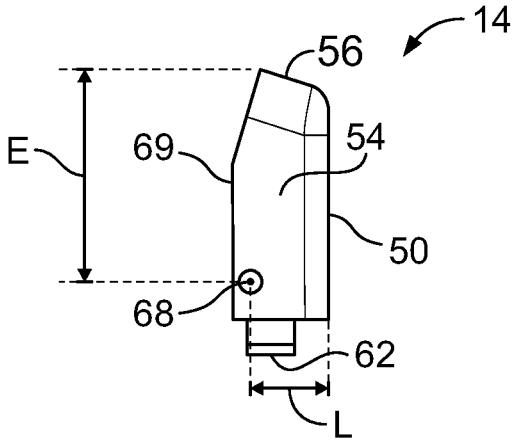
FIG. 10 is a side elevation view of the rear wall shown in FIG. 9.
Figure 11:
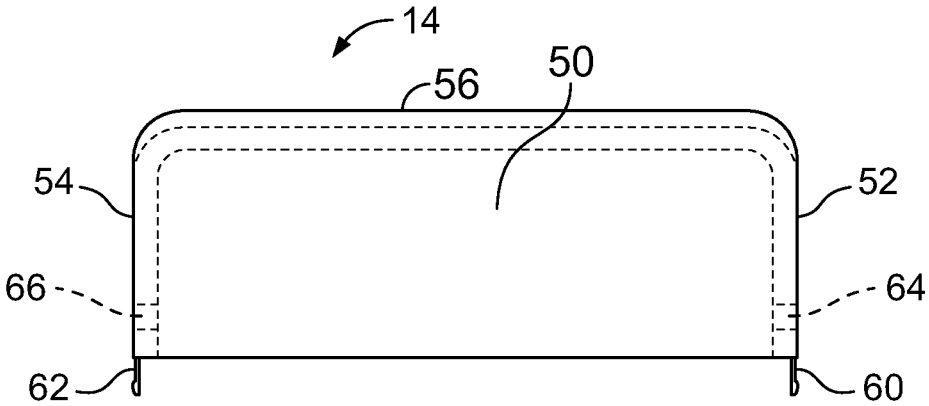
FIG. 11 is a rear elevation view of the rear wall shown in FIGS. 9 and 10.

Referring now to FIGS. 9-11, the rear wall 14 is shown in more detail. The rear wall 14 includes a rear panel 50 mounted to be generally vertical relative to the generally horizontal top surface 22 of the base 12. The rear wall also includes two short side panels 52, 54 and a short upper panel 56. The side panels 52, 54 are generally perpendicular to the rear panel 50. Connected to each side panel 52, 54 is an attachment leg 60, 62 which are dimensioned to be received by the slots 30, 32 located near the rear end 46, FIG. 5, of the base 12, such that the rear wall 14 may be permanently or semi-permanently affixed to the base 12. Each side panel 52, 54 also includes a lower opening 64, 66 for defining an axis of rotation 68, FIGS. 9, 10 and 13, in conjunction with the lid 16. The rotational axis 68 is positioned above the top surface 22 and near the rear end 46 of the base 12. The side and upper panels 52, 54, 56 form a forward facing edge 69. The rear wall 14 cooperates with the lid 16 to form an enclosure for the butter 18 when the butter dish 10 is closed as shown in FIGS. 1 and 2. When the butter dish 10 is opened, the rear wall 14 and the openings 64, 66 are located in a predetermined manner on the base 12 to provide a wide and deep space to enable a user to manipulate a butter spreader without unduly smearing butter on the lid, on the base or on the rear wall, and yet, the butter dish 10 is not overly large.

In the alternative, the rear wall may assume a somewhat different shape and may be formed, if the butter dish material is molded plastic, integral with the base.

The stylish lid 16, as seen in FIGS. 1-3, and 12-14, includes a front panel 70, left and right side panels 72, 74 and an upper panel 76, which blend smoothly with each other. The side panels 72, 74 are generally perpendicular to the front panel 70. The front and side panels 70, 72, 74 form a lower planar rim or edge 78, FIGS. 12 and 13, that mates with the planar region 24, FIG. 5, of the top surface 22 of the base 12 when the lid is in the closed position. The two side panels 72, 74 and the upper panel 76 form a rear rim, border or edge 80, FIG. 14, that defines a rear opening 82 of the lid 16. The top surface 22 of the base and the front, top and side panels 70, 72, 74, 76 of the lid cover the butter on the planar region 24 of the base from five sides. The rear edge 80 mates with the rear wall 14 to close and cover the butter from a sixth side as shown in FIG. 2. Thus, a full enclosure is formed around the butter 18 when the butter dish 10 is in the closed position.

Figure 13:
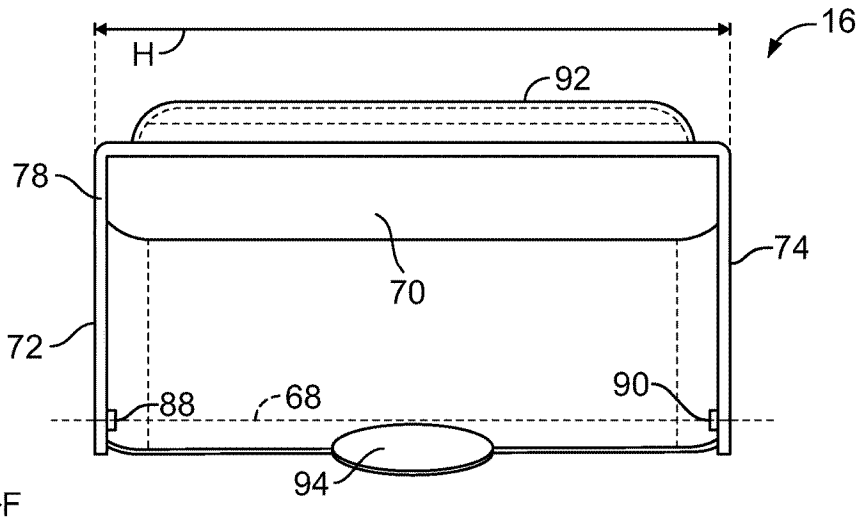
FIG. 13 is a bottom plan view of the lid shown in FIG. 12.
Figure 14:
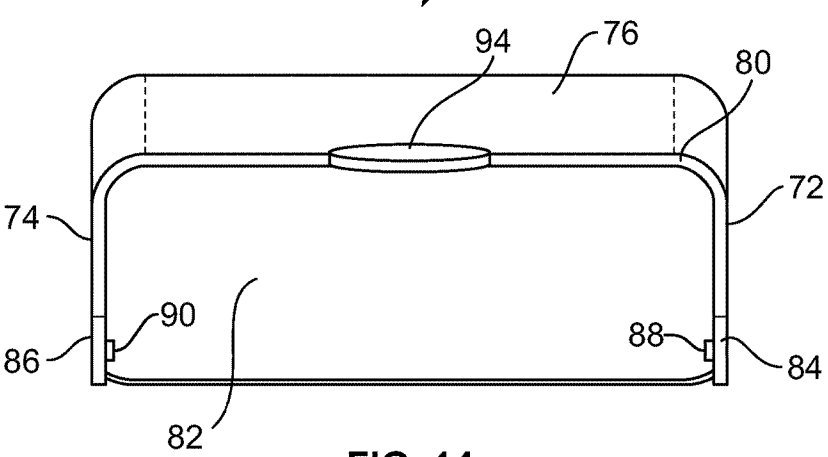
FIG. 14 is a rear elevation view of the lid shown in FIGS. 12 and 13.
Figure 12:
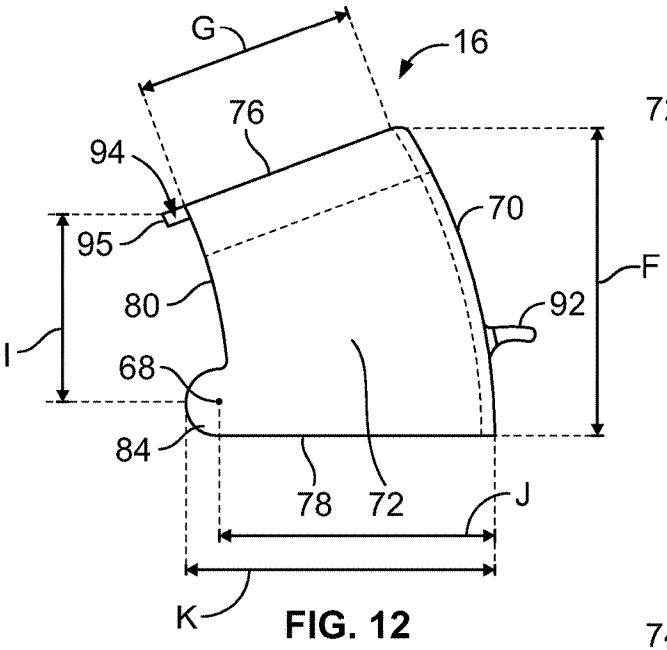
FIG. 12 is a side elevation view of a lid of the butter dish shown in FIGS. 1-4.

Extending from the rear edge 80 at each side panel 72, 74 are tabs 84, 86, and the tabs extend the lower edge 78 rearward as clearly shown in FIG. 12. Extending laterally from the tab 84, FIGS. 13 and 14, is a short shaft 88, and extending laterally from the tab 86 is a short shaft 90. The shafts 88, 90 are received by the openings 64, 66, FIG. 9, respectively, in the side panels 52, 54 of the rear wall 14 and complete the rotational axis 68 to enable the lid 16 to rotate between the closed position shown in FIGS. 1 and 2, and the opened position shown in FIG. 3.

The front panel 70 is smoothly curved upward from the lower edge 78, and the upper panel 76 is positioned obliquely or slanted downward from the top of the front panel 70 to the rear edge 80. Extending outward from the front panel 70 is a handle 92 to facilitate opening and closing the lid. Extending rearward from the upper panel 76 and the rear edge 80 is a bumper 94 with an end portion 95. The bumper is preferably formed of resilient material and functions to limit the rotation of the lid and cushion contact of the lid with the support surface 42, FIG. 4. The lid is constructed and dimensioned, along with the base 12 and the rear wall 14, such that the front panel 70 of the lid and the rear edge 80 are curved and generally parallel to one another, and the rear edge 80 and the lower edge 78 rotate about identical or near identical angles.

In the alternative, the rear wall may mount shafts for receipt by openings in the lid, or fastener elements may be placed in aligned openings in both the rear wall and the lid. The shape of the lid may be more rounded or less so, and other products besides butter may be stored in the butter dish.

In operation of the butter dish 10, a user places the butter dish on a conveniently located countertop or table, near a toaster for example, so that toast may be easily buttered. A stick or block of butter 18 is placed on the planar region 24 of the top surface 22 of the base 12 and the lid 16 is closed as shown in FIGS. 1 and 2. The base 12, the rear wall 14 and the mating lid 16 form an enclosure for the butter to enable the butter to remain out on a countertop or table for a week or more. It has been found that daily refrigeration of butter is not necessary and the butter may, in many cases, remain at room temperature until completely consumed. Storing the butter in typical household ambient conditions enables the butter within a short time to reach room temperature and be relatively soft to make spreading of the butter quite easy. Because the lid 16 opens beyond 90° a user will have little trouble handling the butter spreader 20 and avoiding the lower edge 78 of the lid 16 or other parts of the butter dish 10. If butter does not get smeared on the lower edge 78, the bottom edge of the lid will not stick to the top surface 22 of the base 12. Any excess butter remaining on the knife may be removed by wiping the knife against the front edge 69, FIG. 9, of the rear wall 14.

The preferred dimensions of the butter dish are as follows: the major dimension A, FIG. 5, of the oval base 12 is about 8.5 inches, and the minor dimension B is about 5.25 inches. The width C, FIG. 6, of the recess 26 in the base 12 is about 0.75 inches and the distance D from the recess 26 to the rear end 46 of the base 12 is about 4.15 inches. The height E, FIG. 10, from the rotational axis 68 to the top of the rear wall is about 1.8 inches. The height F, FIG. 12, of the lid 16 from the lower edge 78 is about 2.8 inches, the depth G of the upper panel 76 of the lid 16 is about 2.2 inches, the width H, FIG. 13 of the lid 16 is about 5.85 inches, the height I, FIG. 12, from the rotation axis 68 to the bumper 94 is about 1.9 inches, the distance J from the front panel 70 of the lid 16 to the rotational axis 68 is about 2.55 inches, the distance K from the front panel 70 of the lid to the end of the tab 84 is about 2.85 inches, the distance L, FIG. 10, from the rotational axis 68 to the rear panel 50 of the rear wall 14 is about 0.68 inches, and the distance M, FIG. 4, between the rotational axis 68 to the rear 46 of the base 12 is about 1.5 inches.

(The dimensions provided above are somewhat approximate even though some dimensions extend to two decimal places. This approximation is because the intersections of connecting panels are difficult to discern when curved corners are used as here, unlike for example, a sharp crease in a folded piece of paper. In addition, different materials will form intersections somewhat differently and different wall thicknesses will also affect the geometry of the intersections.) It is noted that the butter dish may be formed of any suitable plastic, metal, ceramic or porcelain, and may even be formed of coated paper.

Figure 4:
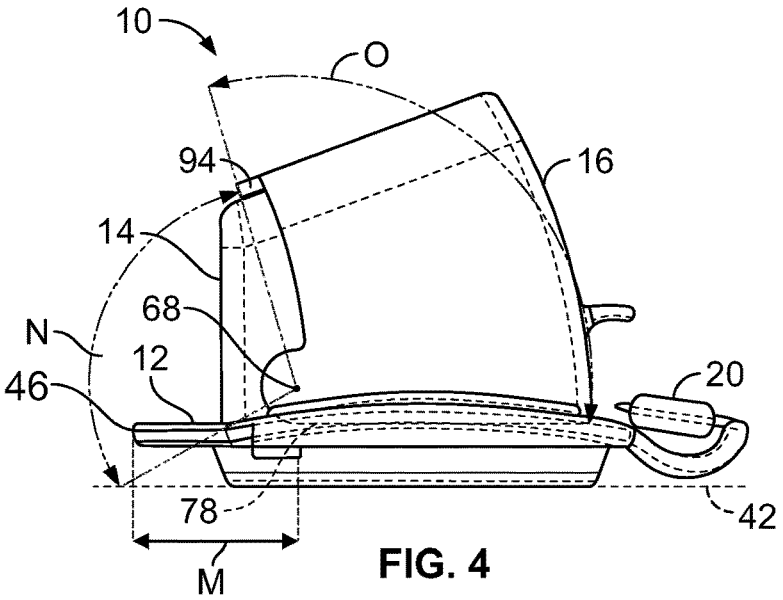
FIG. 4 is a reduced side elevation view of the closed butter dish shown in FIGS. 1 and 2, but including a butter spreader.
Figure 5:
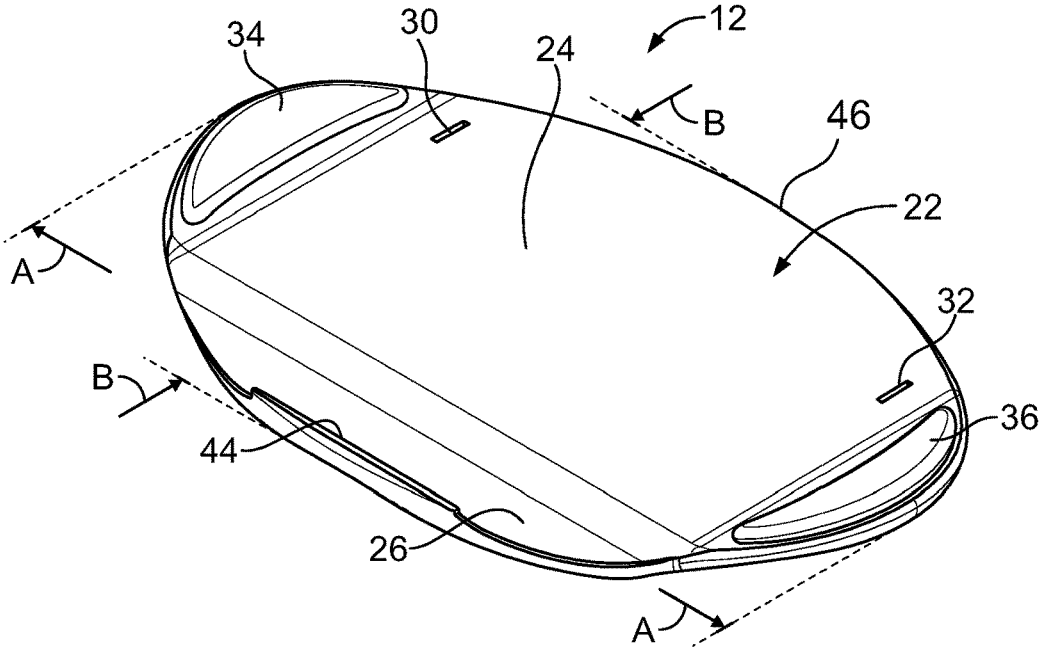
FIG. 5 is an isometric view of a base of the butter dish shown in FIGS. 1-4.
Figure 6:
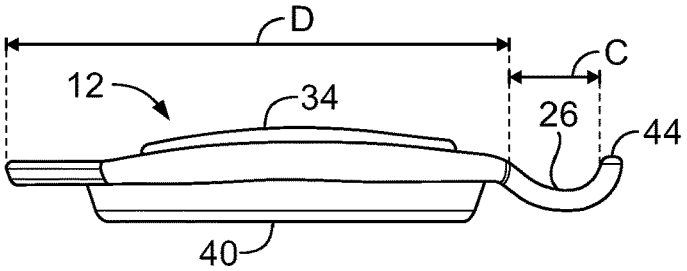
FIG. 6 is a side elevation view of the base shown in FIG. 5.
Figure 7:
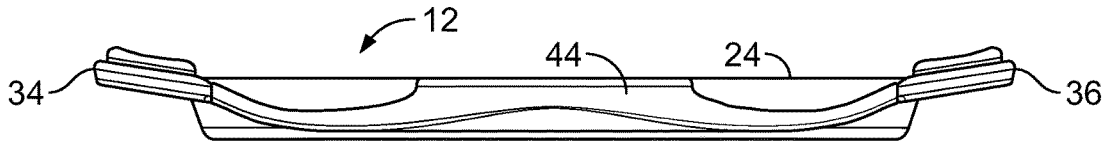
FIG. 7 is a front elevation view of the base shown in FIGS. 5 and 6.
Figure 8:
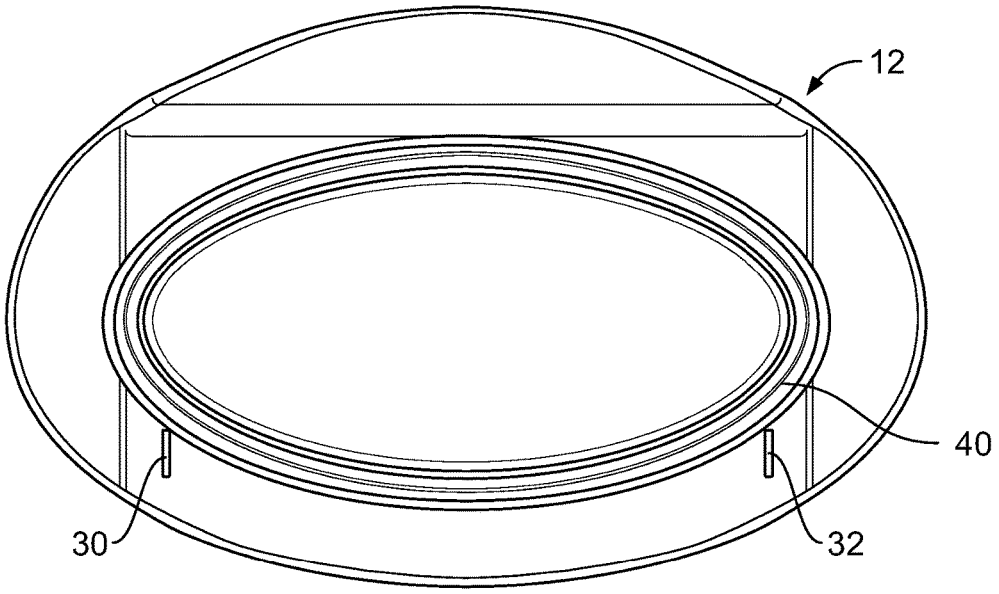
FIG. 8 is a bottom plan view of the base shown in FIGS. 5-7.

Because of the dimensions of the structures set forth above, the angle of rotation N, FIG. 4, of the bumper 94 from the first position of the lid 16 shown in FIG. 4, to the second position of the lid where the bumper contacts the support surface 42 is about 110°, and is generally identical with the angle of rotation O of the lower edge 78 of the lid relative to the planar region 24 of the top surface 22 of the base 12 when the lid moves from the first position to the second position thereby providing for a larger opening to enable a user easy access to the butter 18. It is to be understood that altering the dimension or structure of the bumper 94 itself or relative to the rotational axis 68, and/or the dimension from the rotational axis 68 to the bottom rim 40 of the base 12 (roughly the same distance as to the support surface 42), or the depth dimension of the upper panel 76 of the lid, will alter the angle of rotation of the bumper and of the bottom edge of the lid. Therefore, different sized butter blocks or sticks may be easily accommodated by simple changes in those dimensions and still result in a wide 110° opening. Or in the alternative, the dimensions and structures may be changed should a larger opening be desired.

The plastic material for the butter dish 10 may be ABS, polycarbonate, a blend of ABS and polycarbonate or polypropylene. Soft components, such as the bumper 94, the side pads 34, 36 and the handle 92, may be formed from a thermoplastic elastomer that may be over-molded or molded separately and attached by stretching a part and mechanically interlocking the part with another part. According to Wikipedia, butter sticks are commonly produced in two different configurations: the dominant shape east of the Rocky Mountains is the "Elgin" or Eastern-pack shape and is about 4.8 inches long and about 1.3 inches wide; west of the Rocky Mountains a different shape developed and it is referred to as the Western-pack, and these are about 3.1 inches long and about 1.5 inches wide.

It is noted that throughout this detailed description, words such as "upper," "lower," "front," "rear," "top" and "bottom," as well as similar positional terms, refer to portions or elements of the butter dish as they are viewed in the drawings relative to other portions, or in relationship to the positions of the apparatus as it will typically be deployed and moved during use, or to movements of elements based on the configurations illustrated.

Figure 15:
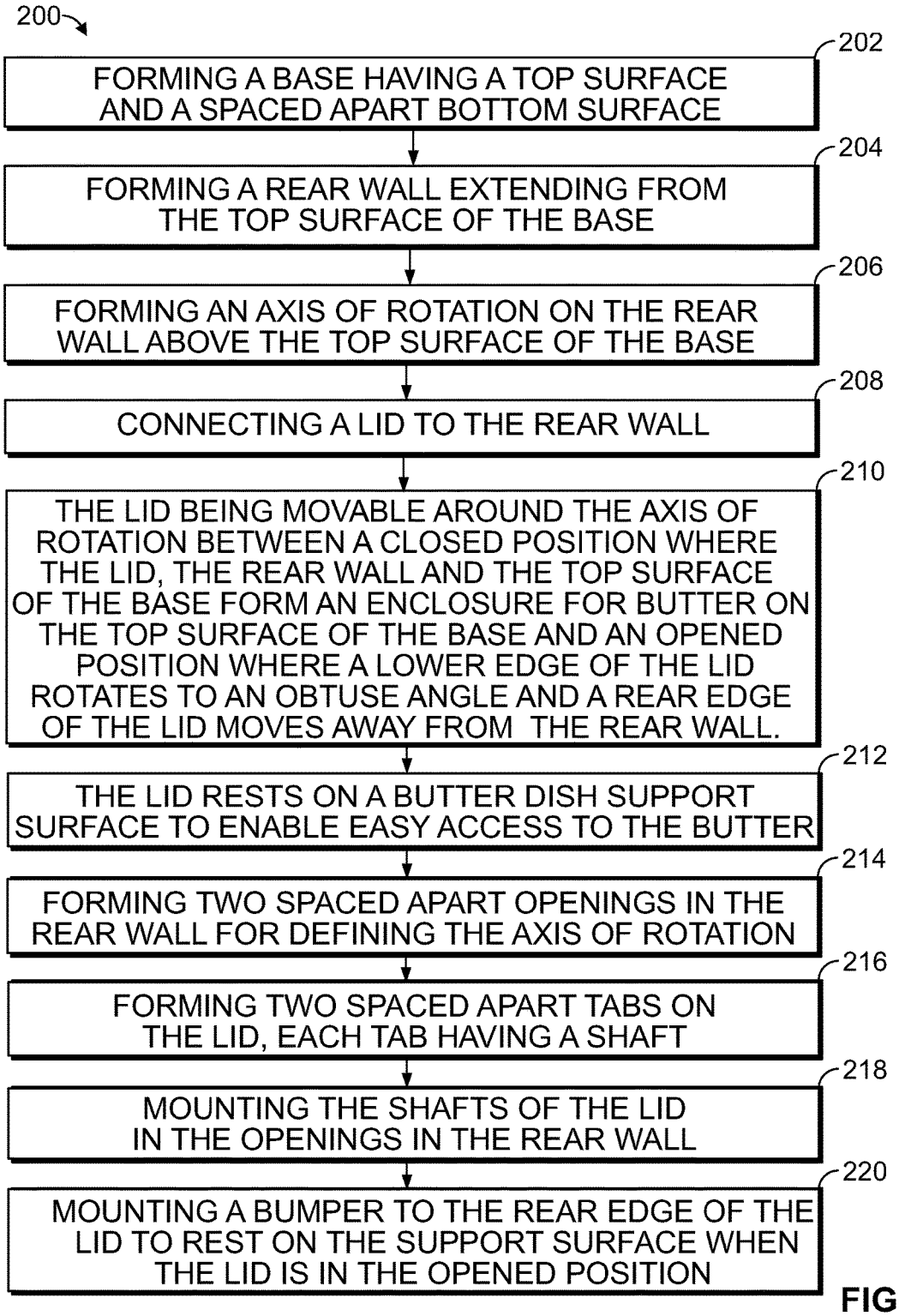
FIG. 15 is a flow diagram of a method for making the butter dish shown in FIGS. 1-4.

A method 200, FIG. 15, is included here for making the butter dish 10 including the steps of forming a base having a top surface and a spaced apart bottom surface 202, forming a rear wall extending from the top surface of the base 204, forming an axis of rotation on the rear wall above the top surface of the base 206, and connecting a lid to the rear wall 208, the lid being movable around the axis of rotation between a closed position where the lid, the rear wall and the top surface of the base form an enclosure for butter on the top surface of the base and an opened position where a lower edge of the lid rotates to an obtuse angle and a rear edge of the lid moves away from the rear wall 210 wherein the lid rests on a butter dish support surface to enable easy access to the butter 212. The method may also include the steps of forming two spaced apart openings in the rear wall for defining the axis of rotation 214, forming two spaced apart tabs on the lid, each tab having a shaft 216, mounting the shafts of the lid in the openings in the rear wall 218, and mounting a bumper to the rear edge of the lid to rest on the support surface when the lid is in the opened position 220.

The butter dish 10 provides for a wide opening to ease access to the butter and prevent inadvertent smearing of the butter on the butter dish lid. The butter dish may also be structured and dimensioned to easily alter the extent of the opening and/or adjust for different size butter sticks or blocks. The butter dish described in detail above is structurally robust but simply constructed, inexpensive to manufacture, compact and adapted to contain butter or other products of different dimensions.

Referring now to FIGS. 16-23, there is shown the inventive embodiments of a butter dish 250 covered by the claims herein. The butter dish 250 that is very similar to the butter dish 10 shown in FIGS. 1-14, however, provisions are made to secure a spreader to a position inside of the lid of the butter dish. The butter dish 250 has the same advantages as the butter dish 10, as well as the advantages of having a smaller depth dimension so that the butter dish 250 may more easily fit into consumer refrigerator butter dish compartments, and hiding the spreader for a more aesthetic appearance.

Figure 16:
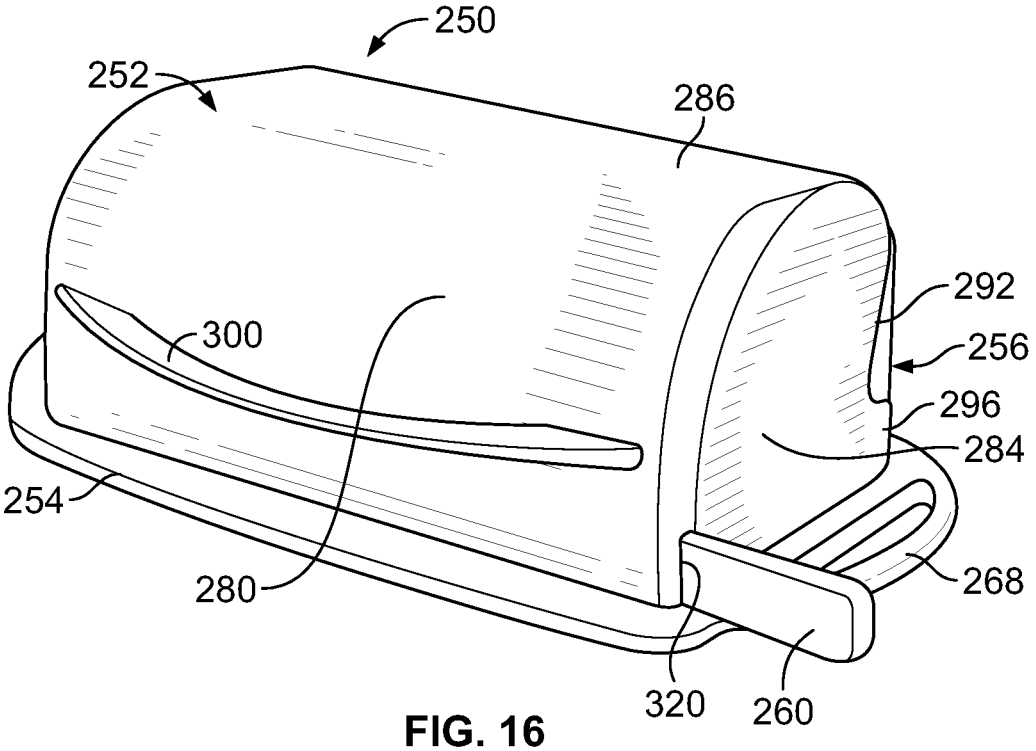
FIG. 16 is an isometric view of a butter dish with spreader of the present invention illustrating the front and side panels of a closed butter dish and an attached securable spreader.

The butter dish 250 includes an attached rotatable cover, closure or lid 252, a stylized base, dish or plate 254, and a rear wall 256 arranged in the same manner as the rear wall of the butter dish 10. The butter dish 250 is shown in a first or closed position in FIGS. 16 and 17, and in a second or opened position in FIG. 18. The butter dish 250 also includes a butter knife or spreader 260 secured to the lid 252 in a partially hidden position, as shown in FIGS. 16 and 17, and an exposed position when the lid 252 is opened, as shown in FIG. 18.

Figure 17:
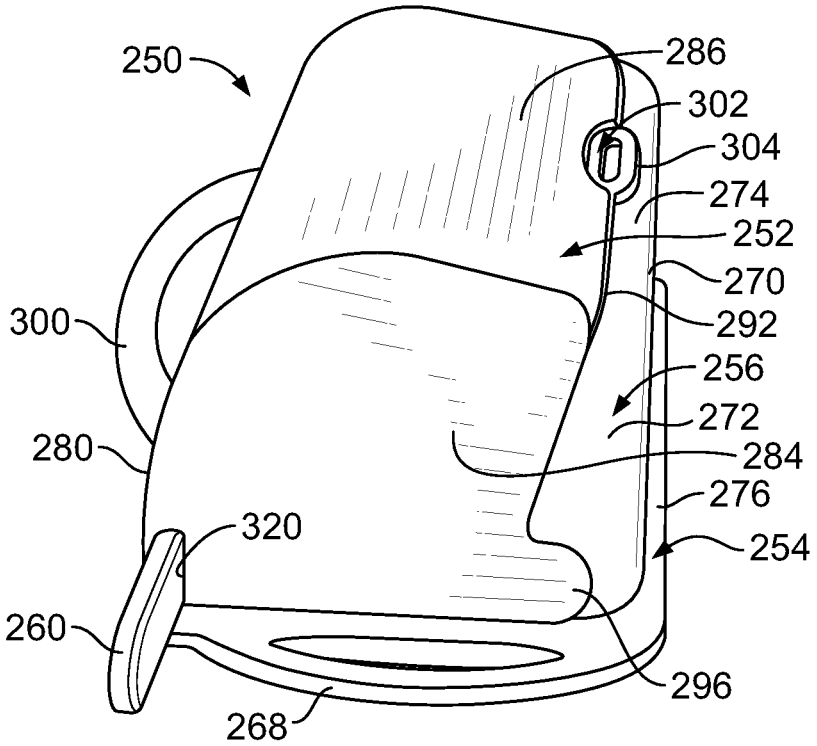
FIG. 17 is an isometric side view of the butter dish with spreader shown in FIG. 16.
Figure 18:
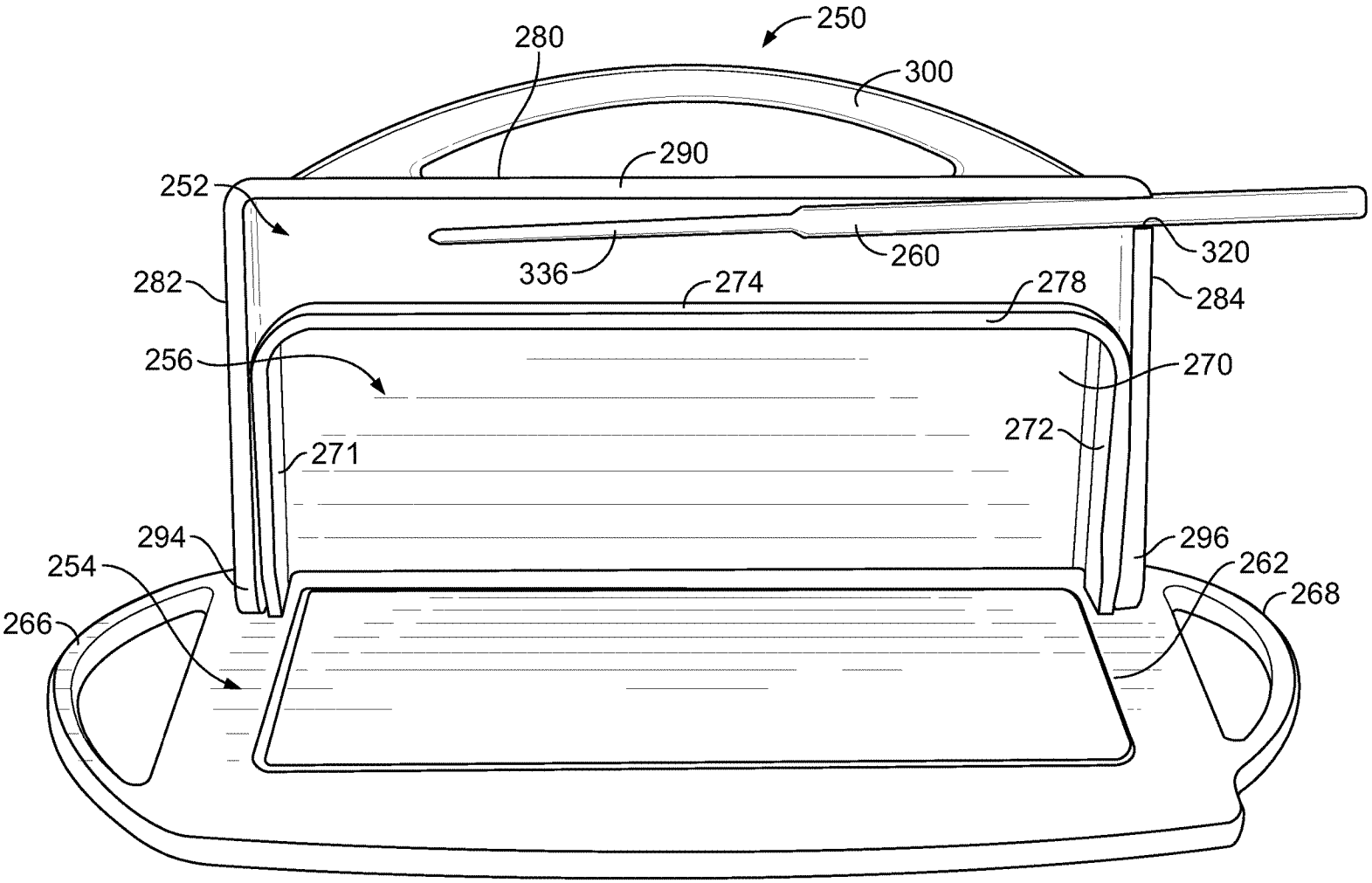
FIG. 18 is an isometric front view of the butter dish with spreader shown in FIGS. 16 and 17

The base 254 may have a somewhat more rectangular shape (when not including side handles) as shown in FIGS. 17 and 18 when compared to the base 12 of the butter dish 10. Like the base 12, the base 254 may include a planar top surface 262 for receiving a block of butter or other product, such as cream cheese. As compared to butter dish 10, the butter dish 250 does not have the front recessed region 26 for storing the butter spreader 20. As with the slots 30, 32 of the butter dish 10, the base 254 may also include two spaced apart slots (not shown) positioned toward the rear of the base 254 for mounting the rear wall 256. Attached at each lateral side along the long dimension of the base may be integral side handles 266 and 268 to facilitate handling of the butter dish 250. Because of the placement of the spreader 260, the one handle 268 may be somewhat smaller than the other handle 266 so as to accommodate the spreader 260.

Spaced a predetermined distance from the top surface 262 of the base 254 is a bottom surface in the form of an oval shaped rim (not shown) identical to the rim 40 of the butter dish 10. The rim may include a non-skid surface or be covered by a non-skid element. The rim is designed to support the butter dish on a support surface such as a kitchen countertop or a table 42. As will be explained below, the dimension between the top and bottom surfaces is chosen, along with other dimensions, to ensure that the lid 252 opens to an obtuse angle regardless of the size of the block of butter enclosed in the butter dish.

The rear wall 256, like the rear wall 14, includes a rear panel 270 mounted to be generally vertical relative to the generally horizontal top surface 262 of the base 254. The rear wall also includes two side panels 271, 272, FIG. 18, and an upper panel 274. The side panels 271, 272 are generally arranged perpendicular to the rear panel 270. Connected to each side panel 271, 272 is an attachment leg (not shown), like the legs 60, 62, the legs being dimensioned to be received by the slots located near a rear end 276 of the base 254, such that the rear wall 256 may be attached to the base 254. Each side panel 271, 272 also includes a lower opening (not shown), like the openings 64,66, for defining an axis of rotation in conjunction with the lid 252. The rotational axis is positioned above the top surface 262 and near the rear end 276, FIG. 17, of the base 254. The side and upper panels 271, 272, 274 form a forward facing edge 278, FIG. 18. The rear wall 256 is structured just like the rear wall 14, and the rear wall 256 engages the base 254 in the same manner as the rear wall 14 engages the base 12.

The rear wall 256 cooperates with the lid 252 to form an enclosure for the butter placed within the butter dish 250. When the butter dish 250 is opened, a wide and deep space is provided to enable a user to manipulate a butter spreader without unduly smearing butter on the lid, on the base or on the rear wall. Nevertheless, the butter dish 250 is relatively compact, even more so than the butter dish 10.

The structure of the lid 252, the rear wall 256 and the relevant parts of the base 254 of the butter dish 250 may be identical to the lid 16, the rear wall 14 and the relevant parts of the base 12 of the butter dish 10.

The stylish lid 252 includes a front panel 280, left and right side panels 282, 284 and a top panel 286, which panels blend smoothly with each other. The side panels 282, 284 are arranged generally perpendicular to the front panel 280, and the front and side panels 280, 282, 284 form a lower planar rim or edge 290, FIG. 18, that mates with the top surface 262 of the base 254 when the lid is in the closed position. The two side panels 282, 284 and the top panel 286 form a rear rim, border or edge 292, FIGS. 17 and 19, which defines a rear opening of the lid 252. The top surface 262 of the base and the front, side and top panels 280, 282, 284, 286 of the lid cover the butter on the top surface 262 of the base from five sides. The rear edge 292 adjoins closely with the rear wall 256 to close and cover the butter from a sixth side. Thus, a full enclosure is formed around the stored butter when the butter dish 250 is in the closed position.

Once again the structure mentioned above relating to the butter dish 250 may be identical with the same structure of the butter dish 10.

Extending from each side panel 282, 284 is a tab 294, 296, and the tabs extend the lower edge 290 to the rear of the butter dish as shown in FIG. 18 exactly as the tabs 84, 86 of the butter dish 10. Extending laterally from each of the tabs 294, 296 is a short shaft (not shown) but identical to the shafts 88, 90 of the butter dish 10. The shafts are received by the openings in the side panels 271, 272 of the rear wall 256 and complete the rotational axis to enable the lid 252 to rotate between the closed and opened positions just like the lid 16 and the rear wall 14 of the butter dish 10.

The front panel 280 of the lid is smoothly curved upward from the lower edge 290, and transitions to the upper panel 286 which is positioned obliquely or slanted downward from the top of the front panel 280 to the rear edge 292. Extending outward from the front panel 280 is a front handle 300 to facilitate opening and closing the lid. Extending rearward from the upper panel 286 and the rear edge 292 is a bumper 302, FIG. 17, with an end portion 304. The bumper is preferably formed of resilient material and functions to limit the rotation of the lid and cushion contact of the lid with a support surface. The lid is constructed and dimensioned, along with the base and the rear wall, such that the front panel 280 of the lid and the rear edge 292 are curved and generally parallel to one another, and the rear edge 292 and the lower edge 290 of the lid rotate about the same angle when the lid is rotated from the closed to the opened positions.

All of the alternatives mentioned above concerning the butter dish 10 also apply to the butter dish 250.

Figure 19:
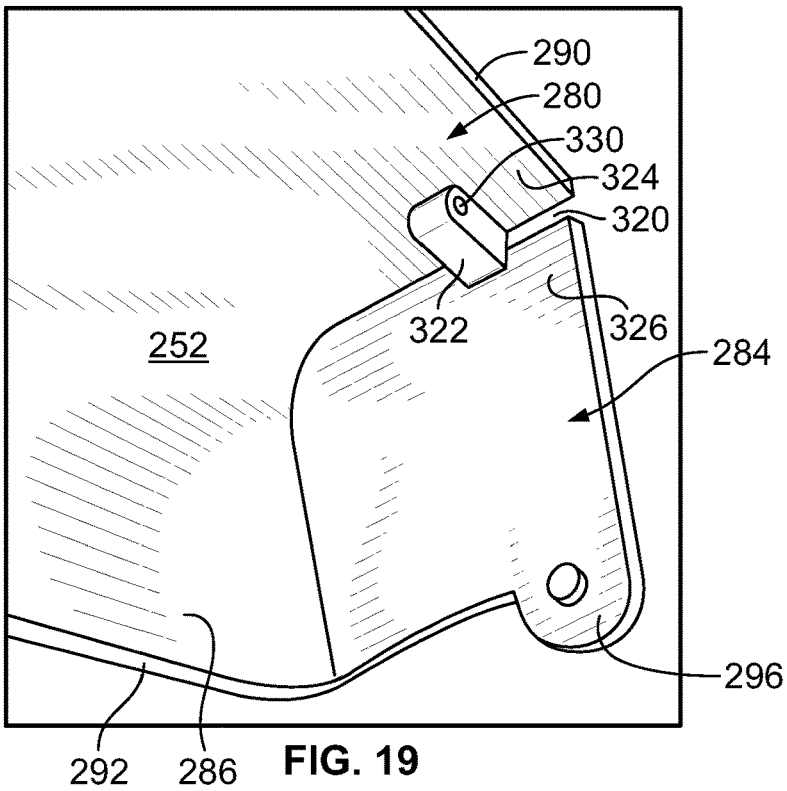
FIG. 19 is an upward looking isometric view of a portion of the inside of a lid of the butter dish shown in FIGS. 16-18, illustrating a slot and a ledge but without the spreader.
Figure 20:
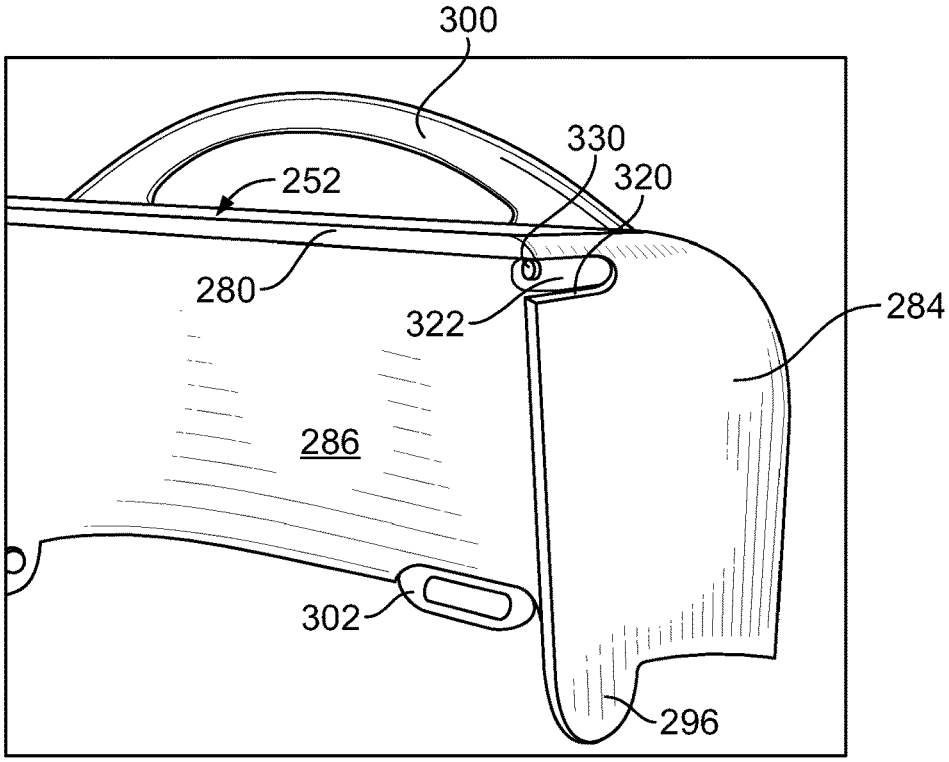
FIG. 20 is an upward looking isometric view of a portion of the lid with the slot and the ledge shown in FIG. 19.
Figure 21:
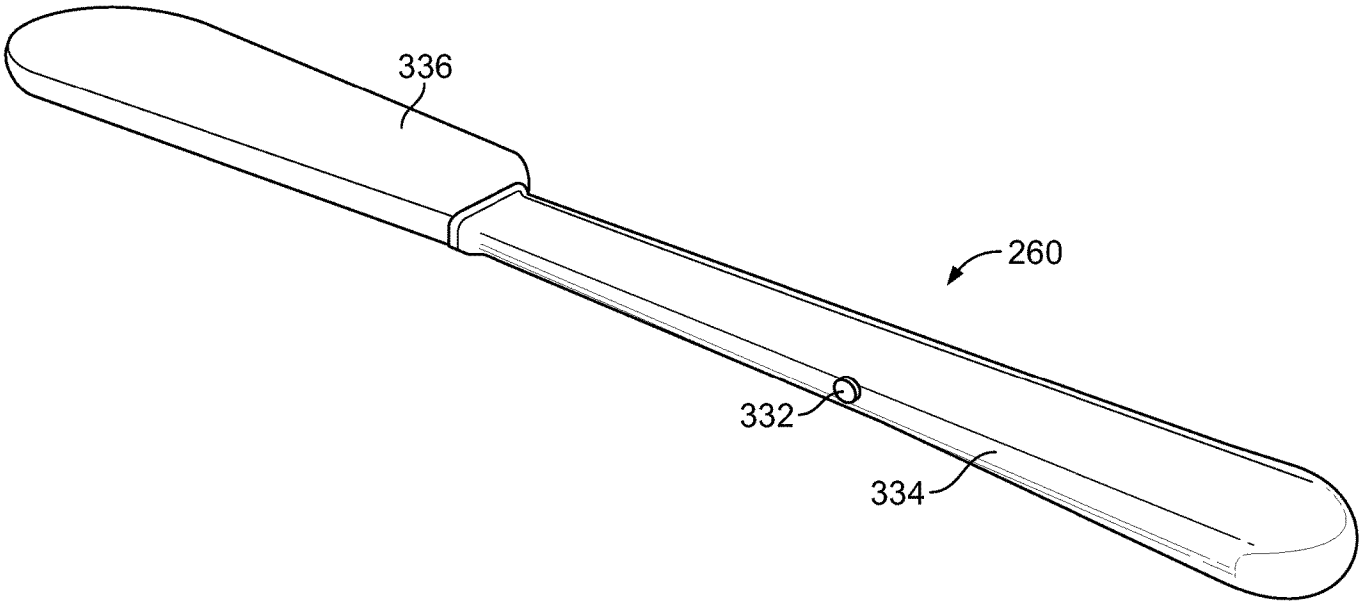
FIG. 21 is an isometric view of the butter dish spreader shown in FIGS. 16-18.
Figure 22:
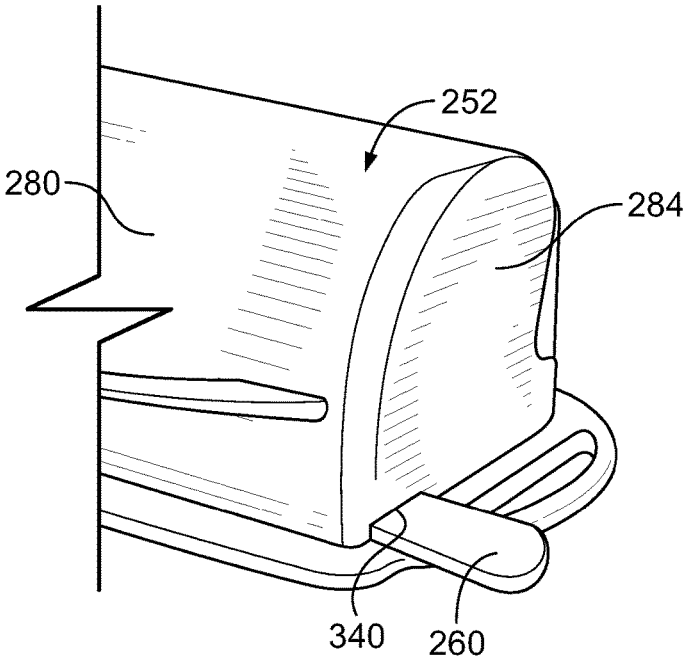
FIG. 22 is an isometric view of a portion of another butter dish with spreader illustrating the front and side panels of a closed butter dish and an attached securable spreader in a position 90° away from the position of the spreader shown in FIG. 16.
Figure 23:
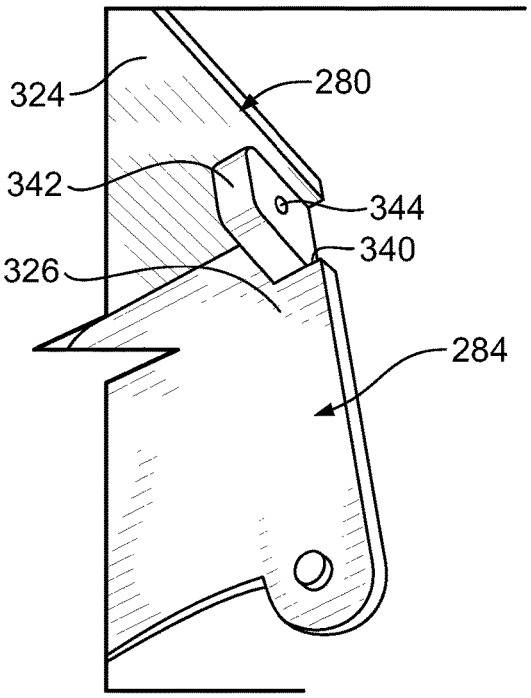
FIG. 23 is an upward looking isometric view of a portion of the inside of a lid of the butter dish shown in FIG. 22, illustrating a slot and a ledge but without the spreader.

The primary difference between the butter dish 10 embodiment and the butter dish 250 embodiment is that the butter dish 250 includes a slot 320, FIGS. 16-19, in the side panel 284 of the lid 252. The slot 320 may extend generally parallel and adjacent to the front panel 280, and align generally vertically when the lid is in the closed position. A protrusion, shoulder or ledge 322, FIGS. 19 and 20, may be formed on an inside surface 324 of the front panel 280 and on an inside surface 326 of the side panel 284 as shown in FIG. 19. The ledge 322 may function as a barrier or stop for the spreader 260 when a user of the butter dish inserts the spreader in the slot to secure the spreader to the lid with the result that the spreader rotates with the lid.

The ledge 322 may support a small magnet 330 that may be disposed in an opening in the ledge 322 and/or adhered to the ledge 322. The magnet 330 is positioned to engage with another magnet 332, FIG. 21, placed in an opening in a top surface 334 of the spreader 260 so as to better retain the spreader once it is placed in the slot 320. One benefit of tucking most of the spreader inside the lid, is a more compact butter dish. Another benefit of the tucked spreader is that should a blade 336 of the spreader have residual butter from a previous use, the blade may be hidden from view, a more aesthetically pleasing arrangement. An additional advantage of the mostly hidden spreader is that the arrangement is more sanitary. When butter residue is left on the spreader and the spreader is left exposed, other food may mix with the residual butter and flies or other bugs may be attracted to the spreader. Furthermore, the spreader and slot may be structured to allow the spreader blade 336 to diverge slightly from the inside surface 324 of the front panel 280 as shown in FIG. 18. This ensures that any residual butter on the blade does not touch the front panel.

In the alternative, the butter dish 250 may include a slightly compressible spreader handle with a slightly larger width than the width of the slot so as to create a very tight fit, sometimes called an "interference fit." The friction between the walls of the slot and the spreader handle is sufficient to maintain the spreader secured to the lid, even during rotation of the lid. Another alternative may include the spreader having a soft outer coating, such as a silicone material, to achieve a tight fit. Still another alternative may include a slot or recess 340, FIGS. 22 and 23, in the side panel 284 of the lid extending perpendicular to the inside surface 324 of the front panel 280 such that the spreader 260 is secured in a position rotated 90° from that shown in FIG. 18. With the spreader placed on its side, a ledge 342 with a magnet 344 may be formed on the inside surface 326 of the side panel 284 and an engaging magnet 346, FIG. 21, may be inserted on a side surface of the spreader 260 instead of on the top surface 334. Or, the relevant dimensions of the spreader and the slot are arranged to create a tight fit with the spreader in the perpendicular attitude.

Figure 24:
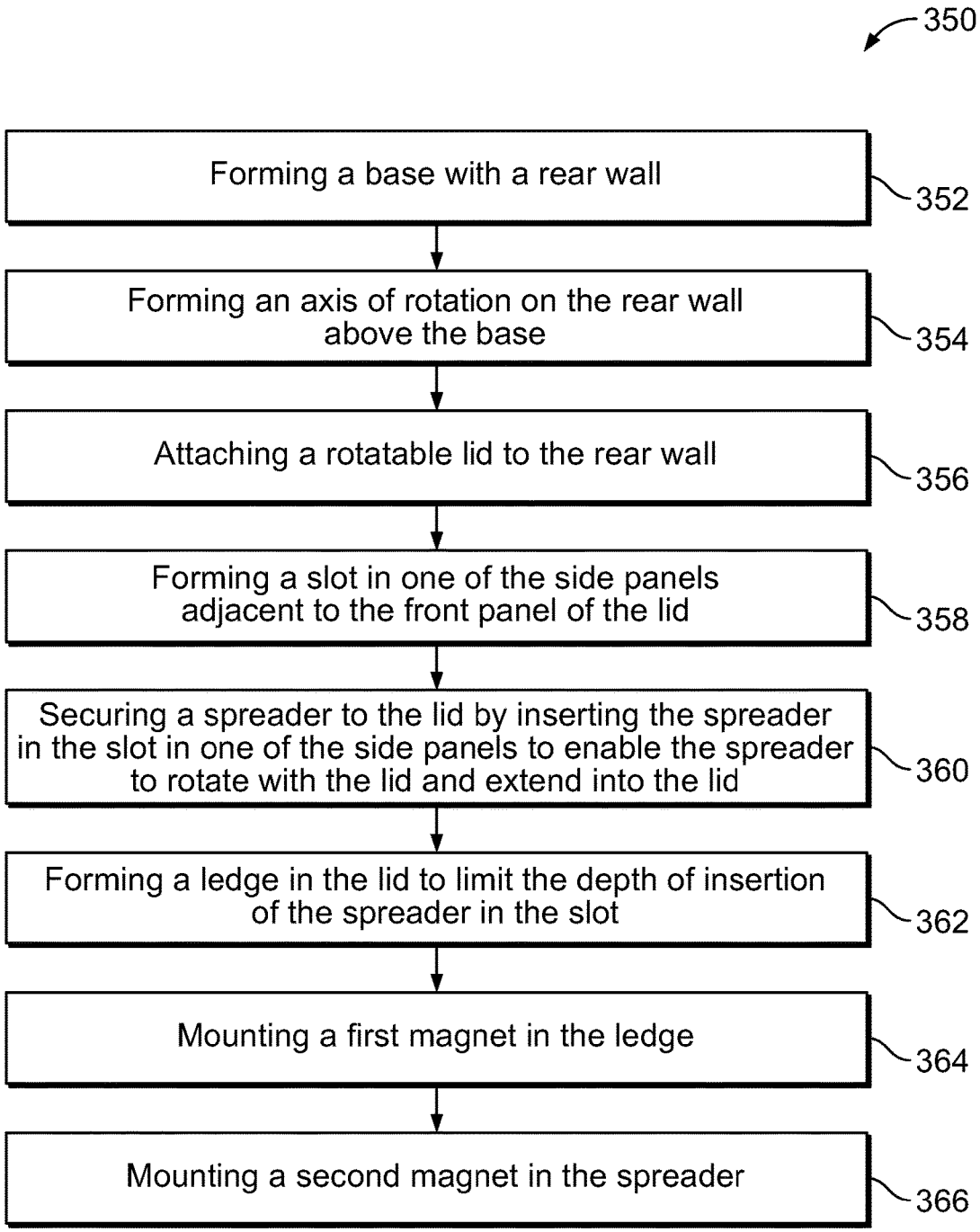
FIG. 24 is a flow diagram of an inventive method for making the butter dishes and spreaders shown in FIGS. 16-23.

The present invention also includes a method 350, FIG. 24, for making a butter dish including the steps of forming a base with a rear wall 352, forming an axis of rotation on the rear wall above the base 354, attaching a rotatable lid to the rear wall 356, the lid having a front panel, a top panel and two spaced apart side panels, forming a slot in one of the side panels adjacent to the front panel 358, and securing a spreader to the lid by inserting the spreader in the slot in one of the side panels to enable the spreader to rotate with the lid and extend into the lid 360. The method may also include the steps of forming a ledge in the lid to limit the depth of insertion of the spreader in the slot 362, mounting a first magnet to the ledge 364 and mounting a second magnet in the spreader 366 such that when the spreader is inserted into the slot the first and second magnets engage.

From the foregoing, it can be seen that there has been provided features for an improved butter dish apparatus and a description of a method for making the butter dish. While particular embodiments of the present invention has been shown and described in detail, it will be obvious to those skilled in the art that changes and modifications may be made, some of which having already been suggested above, without departing from the invention in its broader aspects. Therefore, the aim is to cover all such changes and modifications as fall within the true spirit and scope of the invention. The matters set forth in the foregoing description and accompanying drawings are offered by way of illustration only and not as limitation. The actual scope of the invention is to be defined by the subsequent claims when viewed in their proper perspective based on the prior art.

What is claimed is:

1. A butter dish with a rotatable lid and a spreader comprising:

a base for supporting butter;

a rear wall with two side panels connected to the base for defining a rotational axis, the rotational axis being spaced from the base;

a spreader;

a lid rotatably connected to the rear wall, the lid having a front panel and two spaced apart side panels, wherein one of the two side panels includes a slot adjacent to the front panel for securing the spreader to the lid; and a first magnet connected to the lid.

2. The butter dish of claim 1, including:

a second magnet connected to the spreader.

3. The butter dish of claim 2, wherein:

the first magnet is connected to the lid and positioned to engage the second magnet connected to the spreader.

4. The butter dish of claim 3, wherein:

the slot enables the spreader to be disposed generally parallel to the front panel.

5. The butter dish of claim 4, including:

a ledge extending from an inner surface of the front panel.

6. The butter dish of claim 5, wherein:

the first magnet is connected to the ledge.

7. The butter dish of claim 6, wherein:

the second magnet is connected to the spreader disposed to engage the first magnet connected to the ledge.

8. The butter dish of claim 3, wherein:

the spreader has a thickness to enable the lid to secure the spreader in the slot by friction.

9. The butter dish of claim 3, wherein:

the spreader when secured in the slot enables the spreader to rotate with lid.

10. The butter dish of claim 9, wherein:

the slot enables the spreader to be disposed generally parallel to the front panel; and including a ledge extending from an inner surface of the front panel.

11. The butter dish of claim 10, including:

the first magnet is connected to the ledge; and the second magnet is connected to the spreader disposed to engage the first magnet connected to the ledge.

12. The butter dish of claim 11, wherein:

the slot enables the spreader to be disposed is generally parallel to the front panel.

13. A butter dish with a rotatable lid and a spreader comprising:

a base having a bottom surface for supporting the butter dish on a support surface and a top surface spaced away from the bottom surface, the top surface having a planar region for supporting butter;

a rear wall mounted to the base located near the rear of the base, the rear wall having a back panel extending at a generally perpendicular angle from the base, two side panels extending forward at a generally perpendicular angle from the back panel and having two openings for defining a rotational axis, the rotational axis being spaced from the top surface of the base and located near to the rear of the base;

a lid mounted to the two side panels of the rear wall and forming with the rear wall an enclosure over the base and over any butter on the planar region of the top surface of the base, the lid having a front panel, two side panels and an upper panel with a rear bumper, the front panel and the two side panels forming a lower edge for contacting the planar region of the top surface of the base, and the two side panels and the top panel with the bumper forming a rear opening bordered by a rear edge, wherein the lid is rotatable around the rotational axis between a first position where the lower edge of the lid is supported by the planar region of the top surface of the base and a second position where the lower edge of the lid is disposed at an obtuse angle relative to the planar surface of the top surface of the base; and a spreader for securing in a slot in one of the two side panels to enable the spreader to rotate with the lid.

14. The butter dish of claim 13, including:

a first magnet connected to the lid; and a second magnet connected to the spreader and arranged to engaged the first magnet when the spreader in inserted into the slot.

15. The butter dish of claim 14, including:

a ledge connected to an inner surface of the one of the two side panels having the slot.

16. The butter dish of claim 15, wherein:

the first magnet is supported by the ledge.

* * * * *